US009746162B2

(12) United States Patent
Chen et al.

(10) Patent No.: US 9,746,162 B2
(45) Date of Patent: Aug. 29, 2017

(54) LIGHT EMITTING DIODE BULB

(71) Applicant: ADVANCED OPTOELECTRONIC TECHNOLOGY, INC., Hsinchu Hsien (TW)

(72) Inventors: Lung-Hsin Chen, Hsinchu (TW); Wen-Liang Tseng, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 430 days.

(21) Appl. No.: 14/014,367

(22) Filed: Aug. 30, 2013

(65) Prior Publication Data

US 2014/0119009 A1 May 1, 2014

(30) Foreign Application Priority Data

Nov. 1, 2012 (CN) ..... 2012 1 04303324

(51) Int. Cl.

| | |
|---|---|
| ***F21V 1/00*** | (2006.01) |
| ***F21V 11/00*** | (2015.01) |
| ***F21V 17/16*** | (2006.01) |
| ***F21K 9/23*** | (2016.01) |
| *F21Y 115/10* | (2016.01) |
| *F21Y 107/00* | (2016.01) |

(52) U.S. Cl.

CPC ..... *F21V 17/168* (2013.01); *F21K 9/23* (2016.08); *F21Y 2107/00* (2016.08); *F21Y 2115/10* (2016.08)

(58) Field of Classification Search

CPC ..... F21K 9/13; F21V 17/168; F21Y 2101/02; F21Y 2111/001

USPC ..... 362/235, 650

See application file for complete search history.

(56) References Cited

U.S. PATENT DOCUMENTS

| | | | | |
|---|---|---|---|---|
| 8,952,613 | B2 * | 2/2015 | Anderson | F21V 3/02 315/112 |
| 8,985,815 | B2 * | 3/2015 | Chen | F21K 9/135 362/294 |
| 2011/0286200 | A1 | 11/2011 | Iimura et al. | |
| 2013/0201682 | A1 * | 8/2013 | Chiu | F21V 29/20 362/235 |
| 2015/0036333 | A1 * | 2/2015 | Tsuei | F21K 9/50 362/235 |

FOREIGN PATENT DOCUMENTS

| | | |
|---|---|---|
| CN | 202109397 U | 1/2012 |
| TW | M436120 U1 | 8/2012 |

* cited by examiner

*Primary Examiner* — Andrew Coughlin
*Assistant Examiner* — Jessica M Apenteng
(74) *Attorney, Agent, or Firm* — Steven Reiss

(57) ABSTRACT

A light emitting diode (LED) bulb includes a connecting body, a lamp cap located at a first end of the connecting body, a mounting base located at a second end of the connecting body opposite to the first end, a plurality of LED modules mounted on the mounting base and a sheath assembled to the second end of the connecting body. The sheath includes a first portion and a second portion detachably engaged with the first portion to cooperatively define an enclosed space enclosing the mounting base and the LED modules therein.

20 Claims, 4 Drawing Sheets

LIGHT EMITTING DIODE BULB

TECHNICAL FIELD

The present disclosure relates generally to illumination devices, and more particularly to a light emitting diode (LED) bulb, wherein the LED bulb has a good usability and is provided with convenient installation and removal of LED modules thereof.

DESCRIPTION OF RELATED ART

LEDs are solid state light emitting devices formed of semiconductors, which are more stable and reliable than other conventional light sources such as incandescent bulbs. Thus, LEDs are being widely used in various fields such as numeral/character displaying elements, signal lights, light sources for lighting and display devices.

A traditional LED bulb includes a holder, a substrate located at one end of the holder, a plurality of LED modules arranged on a flat plane of the substrate and a sheath enclosing the substrate and the LED modules arranged on the substrate therein.

However, the sheath is integrally formed and only has a small opening for fitting the substrate and the LED modules arranged on the substrate therein. In addition, when any individual LED module is damaged, the remaining LED modules will be affected and fail to emit light, and thus the entire LED modules must be replaced, which causes inconvenience to the user and accordingly reduces the usability of the product.

What is needed therefore is an LED bulb which can overcome the above mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
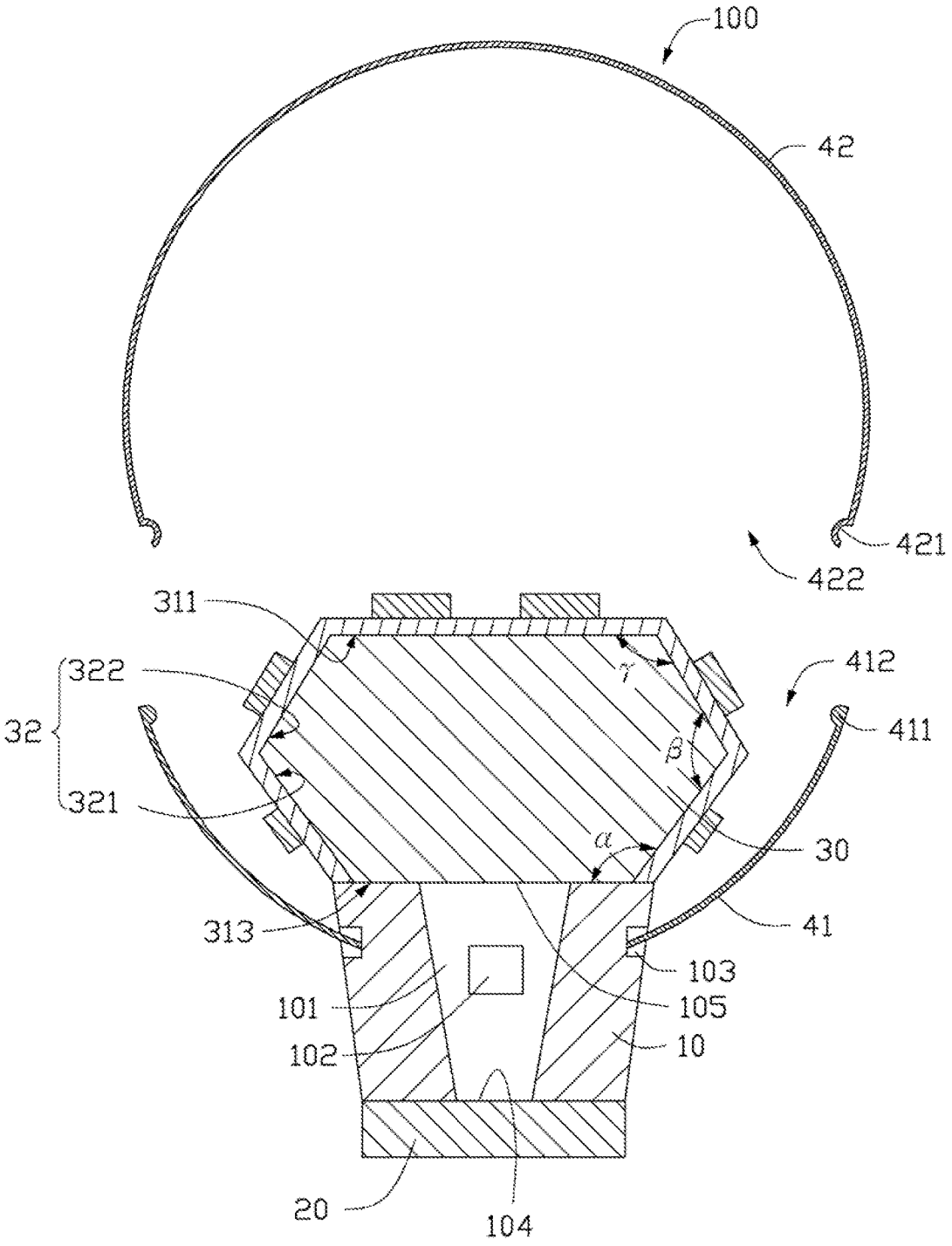
FIG. 1 is an exploded, cross sectional view of an LED (light emitting diode) bulb in accordance with a first exemplary embodiment of the present disclosure.
Figure 2:
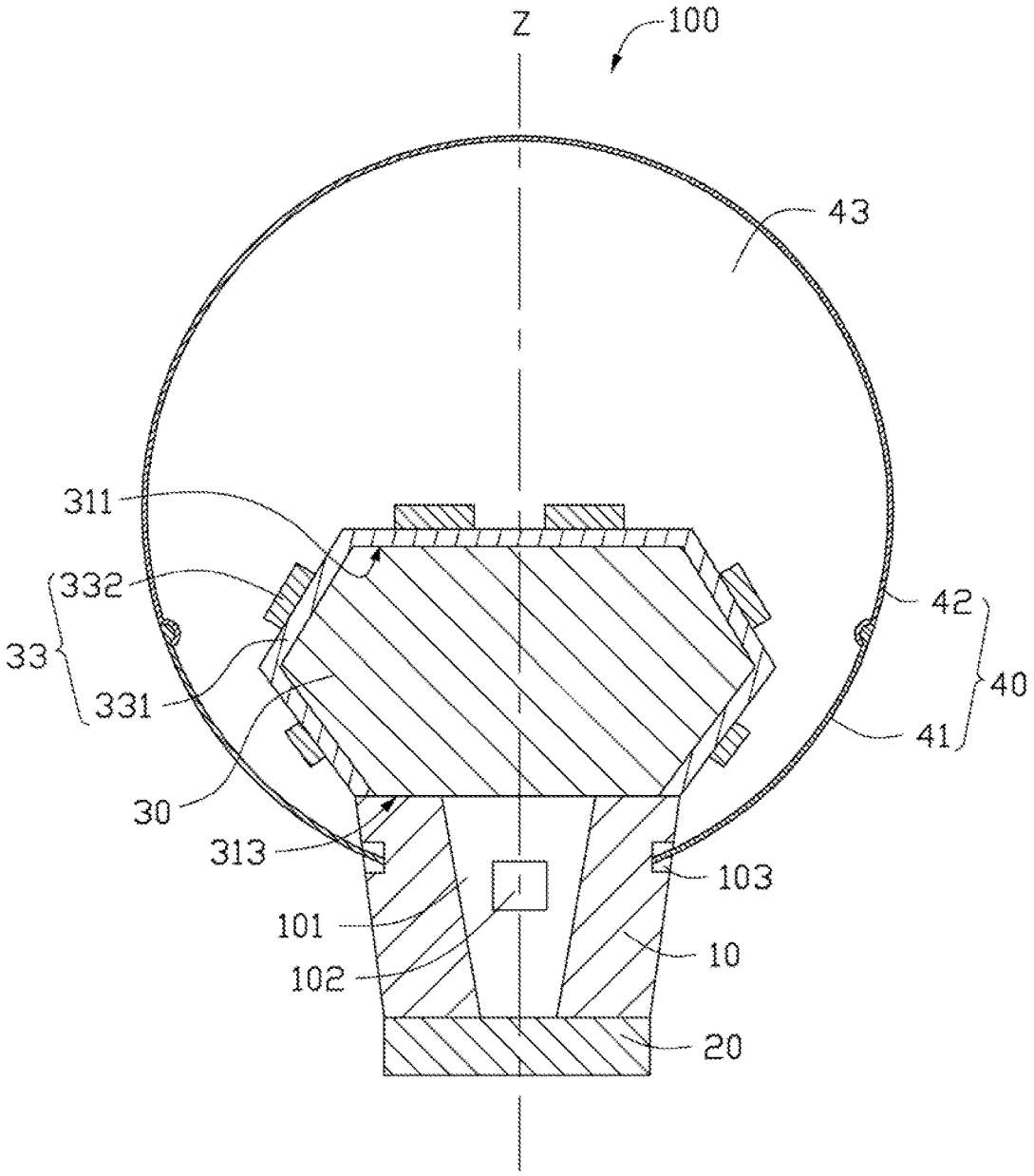
FIG. 2 is an assembled, cross sectional view of the LED bulb in FIG. 1.

Referring to FIGS. 1 and 2, a light emitting diode (LED) bulb 100 in accordance with a first exemplary embodiment of the present disclosure includes a connecting body 10, a lamp cap 20 located at a first end 104 of the connecting body 10, a mounting base 30 located at a second end 105 of the connecting body 10 opposite to the first end 104, a plurality of LED modules 33 arranged on the mounting base 30 and a sheath 40 connected to the second end 105 of the connecting body 10. The sheath 40 includes a first portion 41 and a second portion 42 detachably engaged with the first portion 41 to cooperatively define an enclosed space 43 to enclose the mounting base 30 and the LED modules 33 arranged on the mounting base 30 therein.

The connecting body 10 is a hollow tube and provided with a passage 101 communicating with two opposite open ends, i.e., the first end 104 and the second end 105. The first end 104 of the connecting body 10 is sealed by the lamp cap 20. The second end 105 of the connecting body 10 is sealed by the mounting base 30. In the present embodiment, the second end 105 of the connecting body 10 has a size larger than that of the first end 104. The passage 101 has a diameter gradually increasing from the first end 104 to the second end 105.

The LED bulb 100 further includes a driving circuit module 102 received in the passage 110 of the connecting body 10. The driving circuit module 102 electrically connects the LED modules 33 and the lamp cap 20. The driving circuit module 102 is configured for supplying the electrical power to the LED modules 33

A ring-shaped groove 103 is defined in the connecting body 10. The ring-shaped groove 103 is adjacent to a joint of the mounting base 30 and the second end 105 of the connecting body 10. A bottom portion of the first portion 41 of the sheath 40 is engaged and fixed in the ring-shaped groove 103 of the connecting body 10.

The lamp cap 20 is electrically connected to an external power supply (not shown). For this embodiment, the lamp cap 20 can be a B22 (bayonet 22 mm) male base. In another embodiment, screw threads are formed on an outer circumference of the lamp cap 20 for securing the LED bulb 100 in an external socket. For the another embodiment, the lamp cap 20 can be an E27 (Edison 27 mm) male screw base.

The mounting base 30 is made of material with high heat dissipation efficiency (high heat conductivity), such as aluminum. In the present embodiment, the mounting base 30 is a polyhedron, and the mounting base 30 has a top face 311 spaced from the connecting body 10 and a lateral face 32 interconnecting the connecting body 10 and the top face 311 of the mounting base 30. The top face 311 of the mounting base 30 orients toward a direction different from that of the lateral face 32.

The lateral face 32 of the mounting base 30 includes a first interconnecting face 321 and a second interconnecting face 322 extends from a periphery edge of the first interconnecting face 321. The first interconnecting face 321 extends slantwise upwardly and outwardly from a periphery edge of the second end 105 of the connecting body 10. The second interconnecting face 322 extends slantwise upwardly and inwardly from a periphery edge of the first interconnecting face 321 towards the top face 311 of the mounting base 30. The first interconnecting face 321 of the lateral face 32 orients toward a direction different from that of the second interconnecting face 322 of the lateral face 32.

The mounting base 30 further includes a bottom face 313 spaced from and parallel to the top face 311. The mounting base 30 is connected with the connecting body 10 via the bottom face 313 thereof. The bottom face 313 of the mounting base 30 has a size substantially the same as that of the second end 105 of the connecting body 10. An angle $\alpha$ between the first interconnecting face 321 of the lateral face 32 and the bottom face 313 of the mounting base 30 is an obtuse angle in a range of 100-140 degrees. An angle $\beta$ between the first interconnecting face 321 and the second interconnecting face 322 of the lateral face 32 is an acute angle in a range of 40-80 degrees. An angle $\gamma$ between the second interconnecting face 322 of the lateral face 32 and the top face 311 is an obtuse angle in a range of 100-140 degrees.

Each LED module 33 includes a substrate 331 and at least an LED chip 332 mounted on the substrate 331. In this embodiment, the at least an LED chip 332 can be mounted on the substrate 331 via surface mounted technology. The mounting base 30 is provided with a plurality of through-holes (not shown) on an outer surface thereof. Electrical wires pass through the through-holes to electrically connect the driving circuit module 102 and the plurality of LED modules 33. The LED modules 33 mounted on the top face 311 of the mounting base 30 emit light in a direction different from directions of light from the LED modules 33 mounted on the lateral face 32 of the mounting base 30. Therefore, the plurality of LED modules 33 emit light in all directions into the space around the LED bulb 100, including light toward the backside of the LED bulb 100. Thus, the LED bulb 100 with omnidirectional light distribution similar to an incandescent bulb is obtained.

In the present embodiment, the bottom portion of the first portion 41 of the sheath 40 defines an opening for fitting in the second end 105 of the connecting body 10. The first portion 41 of the sheath 40 clamps into the ring-groove 103 of the connecting body 10. In another embodiment, the first portion 41 of the sheath 40 could be fixed to the connecting body 10 via screwing means, ultrasonic welding or the like.

The first portion 41 of the sheath 40 is bowl-shaped and an inner diameter thereof gradually increases from the second end 105 of the connecting body 10 towards the second portion 42 of the sheath 40. The second portion 42 of the sheath 40 is bowl-shaped and inversely disposed on the first portion 41. The second portion 42 of the sheath 40 defines a second opening 422 facing the first portion 41 of the sheath 40, and the first portion 41 of the sheath 40 defines a first opening 412 matched with and corresponding to the second opening 422 of the second portion 42.

A top portion of the first portion 41 of the sheath 40 adjacent to the first opening 412 projects inwardly to form a first elastic fastening element 411. And a bottom portion of the second portion 42 of the sheath 40 adjacent to the second opening 422 is recessed inwardly to form a second groove 421. When the first portion 41 of the sheath 40 is assembled with the second portion 42 of the sheath 40, the first elastic fastening element 411 of the first portion 41 is elastically deformed to abut against the bottom of the second portion 42 of the sheath 40 until the first elastic fastening element 411 is received in the second groove 421. When the first elastic fastening element 411 is received in the second groove 421, an outer face of the first portion 41 is smoothly connected with an outer face of the second portion 42. The first elastic fastening element 411 and the second groove 421 are located in the space 43 enclosed by the outer faces of the first portion 41 and the second portion 42.

When the LED chips 332 need to be removed from the mounting base 30 of the LED bulb 100, the second portion 42 of the sheath 40 is pressed inwardly to be elastically deformed to make the second groove 421 move toward the LED modules 33, such that the first elastic fastening element 411 of the first portion 41 is disengaged from the second groove 422 of the second portion 42, whereby the second portion 42 is detached from the first portion 41, and the LED chips 332 are exposed and can be removed from the LED bulb 100.

In this embodiment, in the enclosed space 43, the mounting base 30 has a top portion extending upwardly beyond the first elastic fastening element 411 of the first portion 41; in more details, the top face 311 and a portion of the second interconnecting face 322 extend upwardly beyond the first elastic fastening element 411; therefore, when the LED chips 332 need to be removed or replaced, there is a big room for operation.

In this embodiment, the first elastic fastening element 411 is a ring-shaped flange and positioned at the inner surface of the first portion 41 of the sheath 40. In another embodiment, the first elastic fastening element 411 includes a plurality of discrete protruded blocks positioned in a circle around a vertical axis Z of the sheath 40.

The sheath 40 is made of transparent or translucent material which is elastic such as polycarbonate (PC), for transmission of the light emitted from the LED module 33 therethrough. In the present embodiment, the first portion 41 and the second portion 42 of the sheath 40 are made of the same material and have the same refractive index.

Figure 3:
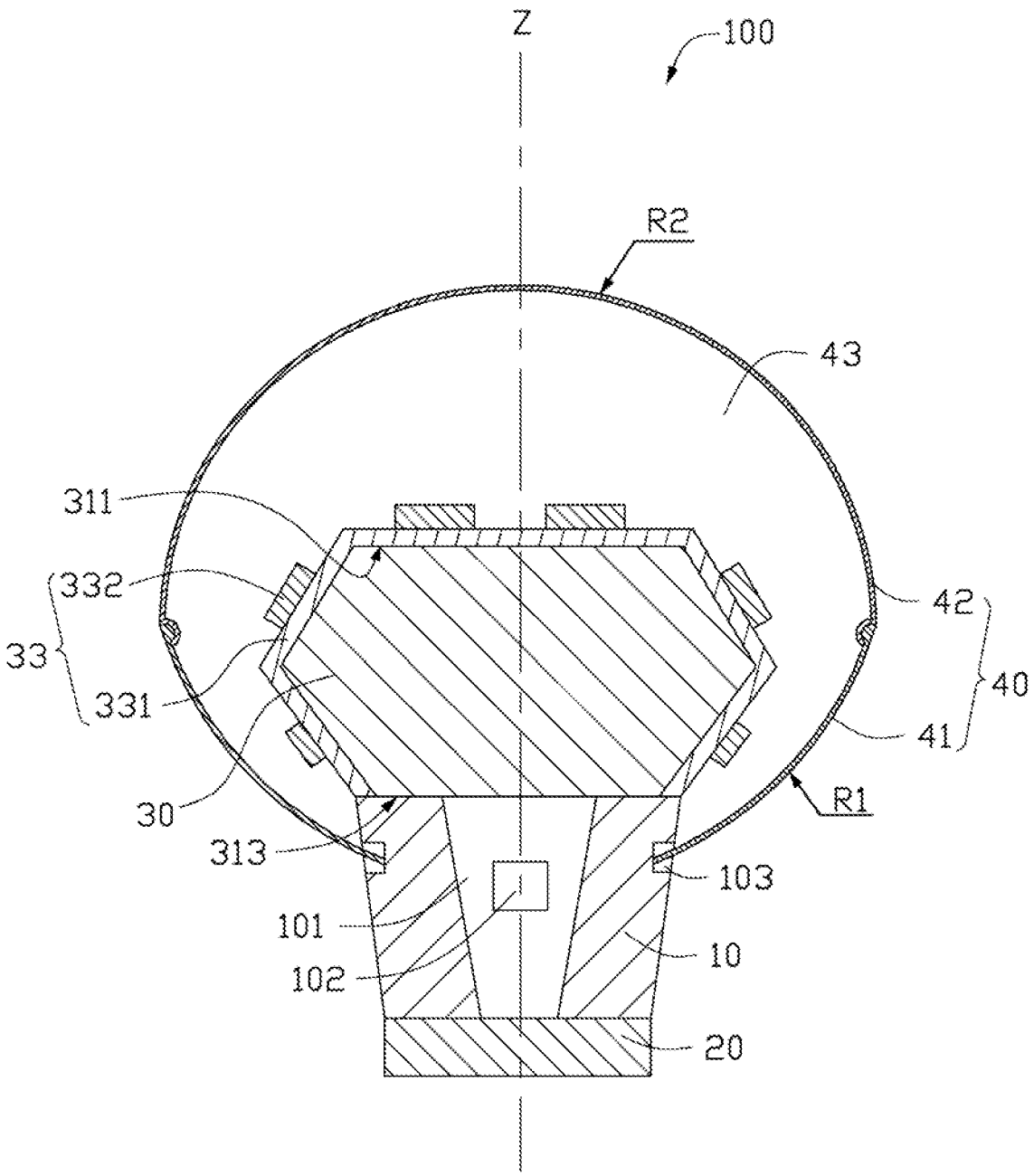
FIG. 3 is an assembled, cross sectional view of an LED (light emitting diode) bulb in accordance with a second exemplary embodiment of the present disclosure.

Referring to FIG. 3, different from the LED bulb 100 shown in FIGS. 1 and 2, the second portion 42 of the sheath 40 is a part of a first sphere having a first radius R1 and the first portion 41 of the sheath 40 is part of a second sphere having a second radius R2 different from that of the first sphere in accordance with a second exemplary embodiment of the present disclosure. In the present embodiment, the second radius R2 of the second portion 42 of the sheath 40 is less than the first radius R1 of the first portion 41 of the sheath 40. Most of the light emitted from the LED module 33 pass through the second portion 42 of the sheath 40 and is refracted by the second portion 42 at a large angle, and a portion of the light is refracted by the first portion 41 of the sheath 40 toward the backside of the LED bulb 100; thus the LED bulb 100 having a uniform light intensity distribution is obtained. In another embodiment, the second portion 42 of the sheath 40 is a part of an ellipsoid, and the first portion 41 of the sheath 40 is part of a sphere.

Figure 4:
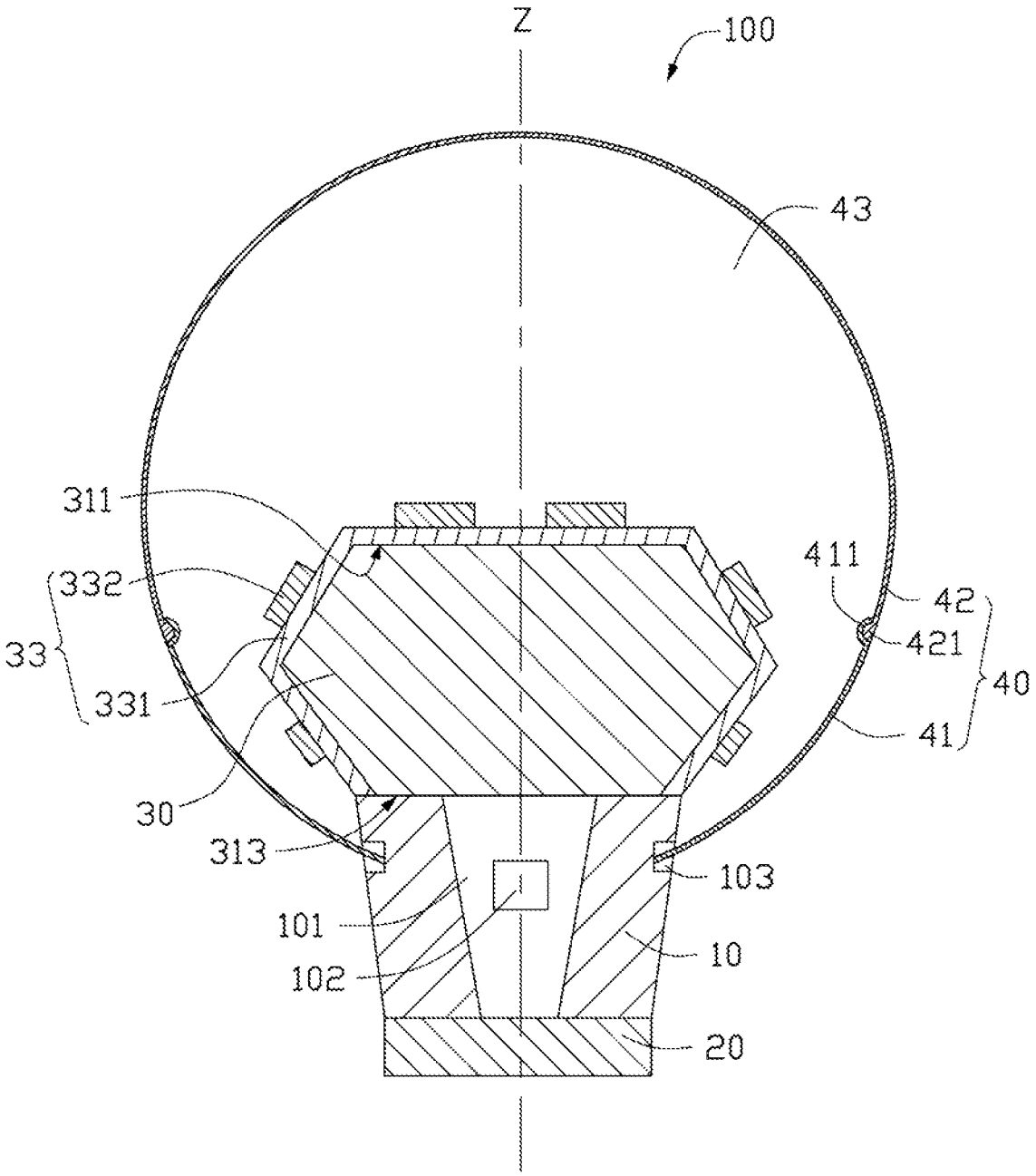
FIG. 4 is an assembled, cross sectional view of an LED (light emitting diode) bulb in accordance with a third exemplary embodiment of the present disclosure.

Referring to FIG. 4, different from the LED bulb 100 shown in FIGS. 1 and 2, a bottom portion of the second portion 42 of the sheath 40 adjacent to the second opening 422 projects inwardly to form a second elastic fastening element 421 in accordance with a third exemplary embodiment of the present disclosure. A top portion of the first portion 41 of the sheath 40 adjacent to the first opening 412 is recessed inwardly to form a first groove 411.

When the first portion 41 of the sheath 40 is assembled with the second portion 42, the second elastic fastening element 421 of the second portion 42 is elastically deformed to abut against the top of the first portion 41 until the second elastic fastening element engages in the first groove 411. In the present embodiment, the second elastic fastening element 421 is a ring-shaped flange and positioned at the inner surface of the second portion 42 of the sheath 40. In another embodiment, the second elastic fastening element 421 includes a plurality of discrete protruded blocks positioned in a circle around a vertical axis Z of the sheath 40. The first portion 41 and the second portion 42 of the sheath 40 are made of different materials and have different refractive indices. The refractive index of the second portion 42 of the sheath 40 is less than that of the first portion 41 of the sheath 40.

In the present disclosure, the sheath 40 includes the first portion 41 and the second portion 42 detachably engaging with the first portion 41 to cooperatively define the enclosed space 43 to enclose the mounting base 31 and the LED modules 33 mounted on the mounting base 31 therein. The user can selectively change radius and refractive index of the second portion 42 or the first portion 41 of the sheath 40 according to actual requirements. When any individual LED module 33 is damaged, it is convenient to replace the damaged LED module 33 by detaching the second portion 42 from the first portion 41 of the sheath 40.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light emitting diode (LED) bulb comprising:

a connecting body having a first end, a second end opposite to the first end, and an outer circumferential surface interconnecting between the first end and the second end;

a lamp cap located at the first end of the connecting body;

a mounting base spaced from the lamp cap and located at the second end of the connecting body;

a plurality of LED modules mounted on the mounting base; and a sheath assembled to the second end of the connecting body, the sheath comprising a first portion and a second portion, the first portion having a top portion and a bottom portion facing away from the top portion, the second portion detachably engaged with the first portion to cooperatively define an enclosed space enclosing the mounting base and the LED modules in the sheath;

wherein a ring-shaped groove is defined in the outer circumferential surface of the connecting body and located between the first end and the second end of the connecting body, the bottom portion of the first portion of the sheath is engaged and fixed in the ring-shaped groove, thereby causing a portion of the outer circumferential surface positioned between the second end and the ring-shaped groove to be enclosed in the enclosed space, and causing a remaining portion of the outer circumferential surface positioned between the ring-shaped groove and the first end to be exposed outside the enclosed space, and the second portion is engaged and fixed at the top portion of the first portion.

2. The LED bulb of claim 1, wherein the first portion of the sheath is bowl-shaped and an inner diameter thereof gradually increases from the second end of the connecting body toward the second portion of the sheath.

3. The LED bulb of claim 2, wherein the second portion of the sheath is bowl-shaped and is flipped over, a bottom portion of the second portion of the sheath is coupled with the top portion of the first portion of the sheath to define the enclosed space.

4. The LED bulb of claim 2, wherein the second portion of the sheath defines a second opening facing the first portion of the sheath, and the first portion of the sheath defines a first opening facing the second opening of the second portion.

5. The LED bulb of claim 4, wherein a bottom portion of the second portion of the sheath adjacent to the second opening projects outwards from an inner surface of the bottom portion of the second portion to form a second elastic fastening element.

6. The LED bulb of claim 5, wherein the top portion of the first portion of the sheath adjacent to the first opening projects inwardly to form a first groove at an outer surface of top portion of the first portion, and when the first portion of the sheath is assembled with the second portion of the sheath, the second elastic fastening element of the second portion is engaged in the first groove of the first portion.

7. The LED bulb of claim 5, wherein the second elastic fastening element is a ring-shaped flange and positioned at the inner surface of the second portion of the sheath.

8. The LED bulb of claim 5, wherein the second elastic fastening element comprises a plurality of discrete protruded blocks positioned in a circle about a vertical axis of the sheath.

9. The LED bulb of claim 4, wherein the top portion of the first portion of the sheath adjacent to the first opening projects outwards from an inner surface of the top portion to form a first elastic fastening element.

10. The LED bulb of claim 9, wherein a bottom portion of the second portion of the sheath adjacent to the second opening projects inwardly to form a second groove at an outer surface of the bottom portion of the second portion, and when the first portion of the sheath is assembled with the second portion of the sheath, the first elastic fastening element of the first portion generates elastic engages in the second groove of the second portion.

11. The LED bulb of claim 9, wherein the first elastic fastening element is a ring-shaped flange and positioned at the inner surface of the first portion of the sheath.

12. The LED bulb of claim 9, wherein the first elastic fastening element comprises a plurality of discrete protruded blocks positioned in a circle about a vertical axis of the sheath.

13. The LED bulb of claim 1, wherein a refractive index of the second portion of the sheath differs from that of the first portion of the sheath.

14. The LED bulb of claim 13, wherein the refractive index of the second portion of the sheath is less than that of the first portion of the sheath.

15. The LED bulb of claim 1, wherein the second portion of the sheath is part of a first sphere having a first radius, and the first portion of the sheath is part of a second sphere having a second radius different from the first radius of the first sphere.

16. The LED bulb of claim 15, wherein the second radius of the second portion of the sheath is less than the first radius of the first portion of the sheath.

17. The LED bulb of claim 1, the second portion of the sheath is part of an ellipsoid, and the first portion of the sheath is part of a sphere.

18. The LED bulb of claim 1, wherein the mounting base is a polyhedron.

19. The LED bulb of claim 18, wherein the mounting base comprises a top face spaced from the connecting body, a lateral face interconnecting the connecting body and the top face, and a bottom face spacing from and parallel to the top face, and the top face and orients a direction different that of the lateral face of the mounting base.

20. The LED bulb of claim 19, wherein the lateral face of the mounting base comprises a first interconnecting face extends slantwise upwardly and outwardly from a periphery edge of the second end of the connecting body and a second interconnecting face extends slantwise upwardly and inwardly from a periphery edge of the first interconnecting face towards the top face, an angle between the first interconnecting face of the lateral face and the bottom face of the mounting base is an obtuse angle in the range of 100-140 degrees, an angle between the first interconnecting face and the second interconnecting face of the lateral face is an acute angle in the range of 40-80 degrees, and an angle between the second interconnecting face of the lateral face and the top face is an obtuse angle in the range of 100-140 degrees.

* * * * *